United States Patent [19]

McGrail et al.

[11] Patent Number: 5,027,035

[45] Date of Patent: Jun. 25, 1991

[54] SEARCH LAMPS AND TORCHES

[75] Inventors: Peter McGrail; Grace McGrail, both of Bury; Geoffrey A. Williams, Castleton; Brian J. Ward, Rochdale, all of England

[73] Assignee: Topline Leisure Limited, Cheshire, England

[21] Appl. No.: 403,408

[22] Filed: Sep. 6, 1989

[30] Foreign Application Priority Data

Sep. 6, 1988 [GB] United Kingdom ..... 8821846

[51] Int. Cl.[5] ..... H05B 41/00

[52] U.S. Cl. ..... 315/119; 315/120; 315/127; 315/129; 315/291

[58] Field of Search ..... 315/32, 33, 76, 119, 315/120, 127, 129, 133, 225, 226, 291; 362/21, 190, 276, 295

[56] References Cited

U.S. PATENT DOCUMENTS

| | | | |
|---|---|---|---|
| 4,039,893 | 8/1977 | Corbley | 315/127 X |
| 4,309,745 | 1/1982 | Zelina, Jr. | 362/186 |
| 4,455,509 | 6/1984 | Crum et al. | 315/127 X |

FOREIGN PATENT DOCUMENTS

| | | |
|---|---|---|
| 557021 | 5/1957 | Belgium . |
| 220617 | 4/1910 | Fed. Rep. of Germany . |
| 2204408 | 1/1972 | Fed. Rep. of Germany . |

*Primary Examiner*—Robert J. Pascal

*Attorney, Agent, or Firm*—Oliff & Berridge

[57] ABSTRACT

A torch particularly for use in hazardous conditions has safety and battery power warning features. The supply from a power source (34) to a light source (12) includes a frangible conductive element (132) in the conductive path to the light source (12). The conductive element (132) is provided on a torch glass (128), so that if the glass (128) breaks, the power supply to the lamp (12) will be cut off, thereby eliminating the risk of sparks, and exposure of the hot lamp element to the atmosphere. The torch also has a switch (22) and relays (38, 40) enabling batteries of the power source (34) to be switched between series and parallel arrays, enabling the torch to operate at full or low power. The torch also has a battery voltage sensing and indicating means, which cause the light source (12) to flash when battery voltage reaches a first predetermined level, and for the light source (12) to be switched off permanently when battery voltage reaches a second predetermined level.

13 Claims, 4 Drawing Sheets

SEARCH LAMPS AND TORCHES

BACKGROUND OF THE INVENTION

This invention relates to search lamps and torches, hereinafter referred to as torches.

In particular the invention relates to a high power torch for use in arduous and hazardous situations, having safety and power level warning features.

SUMMARY OF THE INVENTION

The present invention seeks to provide a torch which can be used in situations where there are likely to be explosions due to, for example, leakages of gases of chemicals, the torch having safety features to prevent exposure of the hot lamp element to the atmosphere, and spark generation by the torch in the event that the torch is damaged.

The present invention also seeks to provide a torch which is of high intensity and which can be used in circumstances such as are encountered by all types of rescue services, military, police, security and airline applications, and in petro-chemical plants, sewers, oil tankers and oil rigs.

The invention further seeks to provide a torch which can be used underwater and is capable of floating.

Accordingly, the present invention provides in one aspect, a torch having a direct current power supply, at least one light source connected to the power supply by conductive elements, a part of at least one said element comprising a length of frangible conductive material attached to a removable and breakable part of the torch.

The torch can comprise a housing having an opening arranged to receive the at least one light source, the opening being closable by a translucent closure member, with the frangible conductive material being attached to the translucent closure member, the ends of the frangible material being arranged to contact terminals on the said one of the conductive elements.

The torch can have a power supply control circuit having a manually operated switch, the switch having at least two positions allowing the power source to be connected or disconnected to the light source, the frangible conductive material being located in the conductive path to the manual switch.

The frangible conductive material can be provided in the positive conductive element to the light source from the power source.

The power supply control circuit can include switching means enabling two or more batteries comprising the power source to be switched into a parallel array or a series array, so as to provide full power or reduced power to the at least one light source.

The power supply control circuit can also have voltage sensing and indicating means to indicate a state or states of the power source.

The voltage sensing and indicating means can indicate a first state of the power output from the power source by means of a flashing light and indicate a second state by switching off the power supply to the at least one light source.

The power supply can include charging means and connecting means enabling the torch to be connected to the battery of a motor vehicle, or any suitable auxiliary supply.

BRIEF DESCRIPTION OF THE DRAWINGS

The present invention will now be more particularly described with reference to the accompanying drawings in which.

DESCRIPTION OF THE PREFERRED EMBODIMENT

Figure 1:
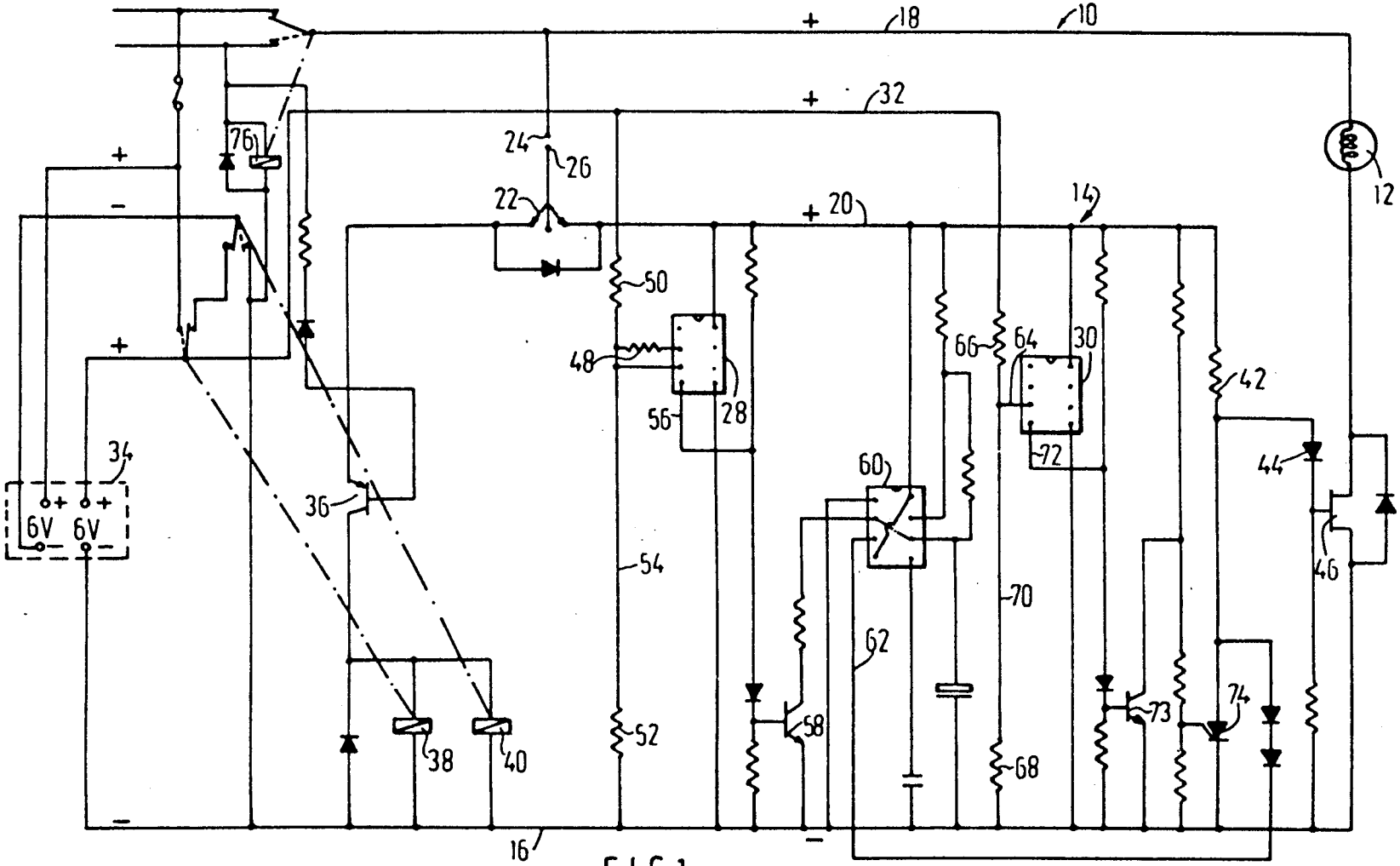
FIG. 1 shows a circuit for one form of torch according to the present invention.

Referring to FIG. 1, the circuit comprises a main power supply circuit 10 to a lamp or bulb 12 and an ancillary circuit 14, the two circuits having a common negative line 16, but the circuit 10 has a separate positive line 18.

The positive supply to the circuit 14 comprises a line 20 which receives a positive supply from the line 18 via a switch 22 and a frangible conductive element (FIG.8) across two contacts 24 and 26.

Two components of the ancillary circuit 14, namely two model 8211 integrated circuits 28 and 30 receives a reference voltage directly from a positive line 32 from a power source 34.

The power source comprises in this embodiment two 6V batteries which can be arranged in series or parallel by operation of the switch 22 as will be described below.

The ancillary circuit 14 uses the intergrated circuit 28 to sense a first pre-determined voltage from the power source, which voltage when sent causes the integrated circuit 28 to have an output to alternately switch off and on the power supply to the bulb 12 as will be described later.

The further integrated circuit 30 is arranged to sense a lower voltage than the integrated circuit 28 and when that lower voltage is sensed the output of the integrated circuit 30 causes the power supply to the bulb to be switched off permanently, as will also be described below.

The bulb 12 is provided with the usual reflector (not shown) together with a translucent protective closure member (FIGS. 6 and 8) which is usually formed from a high impact resistance glass. The torch comprises a housing, see FIGS. 3 to 7 described below having an opening adapted to receive the bulb and reflector and the glass closure. The contacts 24 and 26 are provided adjacent the opening in the housing for the closure member and a frangible conductive material usually in the form of a thin strip of metal is attached to the closure member so as to bridge the terminals 24 and 26, thereby providing a conductive path from the positive line 18 to the switch 22.

It will be appreciated that when the switch is in one of the two on positions providing either full power or reduced power to the bulb, both the main circuit 10 and ancillary circuit 14 will be live. If the torch is being used in a hazardous situation, it is essential to reduce the risk of sparks and the exposure of the hot lamp element to atmosphere in case of starting fires or explosion. Should the torch be dropped and the glass in the torch be broken as tends to be the case, the frangible conductive element on the torch glass will break, thereby disconnecting the positive supply to the ancillary circuit 14 directly, and indirectly to the main circuit 10, thereby eliminating any chance of sparks being created within the torch or the exposure of the hot lamp element to the atmosphere.

The ancillary circuit 14 includes a transistor 36 and two relays 38 and 40. The relays 38 and 40 are arranged to keep the batteries of the power source 34 in a series array as shown in the drawing when they are in a de-energized state. When the switch 22 is moved to the right-hand position in the drawing the power source 34 in series will switch full power to the bulb 12 via the ancilary circuit 14, in particular via a resistor 42, diode 44 and field effect transistor 46.

When switch 22 is moved to the left-hand position the relays 38 and 40 will be energized via the transitor 36 and will cause the relays to move to the position shown in chain lines, thereby connecting the batteries of the power source 34 into a parallel array. The power to the bulb 12 will then be reduced enabling the torch to be operated at that lower power for longer periods of time than would otherwise be the case.

The integrated circuit 28 which forms one part of the battery voltage sensing and indicating means, has an input 48 taken off between two resistors 50 and 52 in a line 54 across the positive line 32 and the common negative line 16. When the voltage on the input 48 reaches a certain pre-determined level it will trigger an output 56 which causes a transistor 58 to have an output to a model 555 timer 60. There will be an alternating off and on output 62 which will operator the switch 46 to alternately supply or disconnect power to the bulb 12 giving a visual indication that the battery power is reducing.

The other integrated circuit 30 comprises the other part of the power sensing and indicating means and has an input 64 taken off between two resistors 66 and 68 in a line 70 which also connects the positive line 32 and the common negative line 16.

When the input 64 reaches a further pre-determined voltage which is lower than the pre-determined voltage on the input 48, there will be an output 72 from the circuit 30 to a transistor 73 causing an output from the transistor 73 to a thyristor 74. The output from the thyristor will then remain in a permanent state maintaining the switch 46 in an off position thereby disconnecting the power supply to the bulb 12 giving a visual indication that the power level has dropped to an unacceptable level.

The torch can also be powered directly from a 12 volt DC supply by an appropriate plug, socket and lead. The circuit as shown in the drawing includes a relay 76 which when actuated by connection to a 12 volt DC supply moves the relay to the chain line position, not only enabling the positive supply to be fed to line 18 but also disconnecting the power supply from the power source 34.

Figure 2:
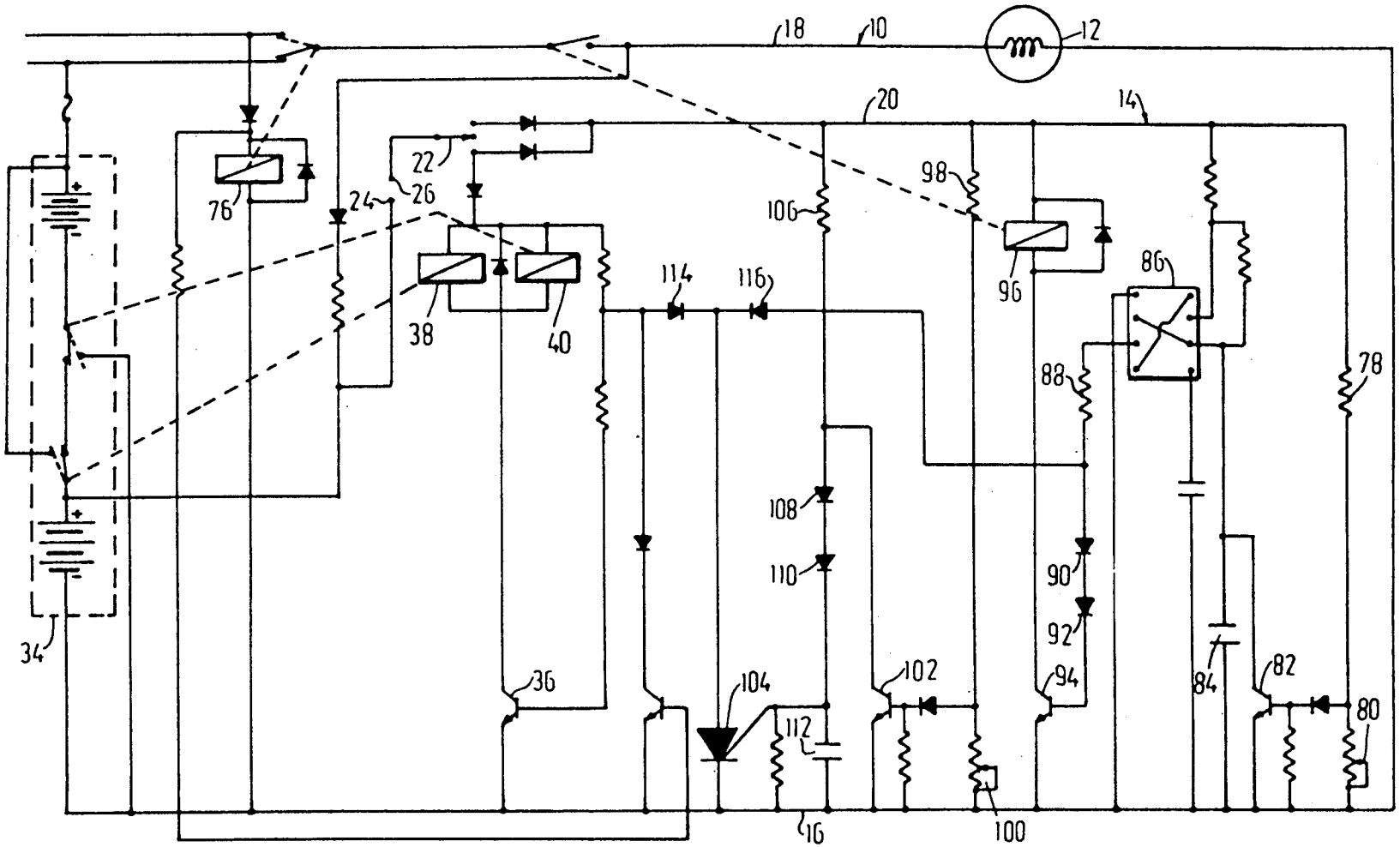
FIG. 2 shows a circuit for a further form of torch according to the present invention.

Referring to FIG. 2 in which components common to both FIG. 1 and 2 have been given the same reference, there is shown a circuit for a torch in which the circuit 10, bulb 12, circuit 14, line 16, line 18, line 20, switch 22, contacts 24 and 26, power source 34, transistor 36 and relays 38 and 40 and 76 are the same or similar to the corresponding components shown in FIG. 1.

Thus the power source 34 is identical to the power source 34 in FIG. 1, and the switch 22 operates in the same way to switch batteries of the power 34 into parallel to reduce the power supply to the bulb 12.

The major difference between the circuit shown in FIGS. 1 and 2 lies in the battery voltage sensing and indicating means of the ancillary circuit 14. The battery voltage and indicating means comprises first and second voltage sensing and indicating means, having both common and unique components.

The first battery voltage sensing and indicating means comprises a fixed resistance 78, a variable resistance 80, transistor 82, capacitor 84, a timer 86 which is common to both battery voltage sensing and indicating means, resistance 88, diodes 90 and 92 and transistor 94 and relay 96 which are common to both first and second battery voltage sensing and indicating means.

As well as the common components mentioned above the second battery voltage sensing and indicating means, includes fixed resistance 98, variable resistance 100, transistor 102, thyristor 104, resistance 106, diodes 108 and 110, capacitor 112 and diodes 114 and 116.

The first battery voltage sensing and indicating means function to cause the lamp 12 to flash off and on, indicating that the battery out-put voltage has reached a first voltage, which is less than normal. This predetermined sensed voltage is set by means of the variable resistance 80. When the battery voltage is normal the transistor 82 is on and prevents the capacitor 84 from charging. When the voltage across resistance 78 drops below the predetermined level, the voltage to transistor 82 drops and the capacitor 84 can charge, thereby activating timer 86. A pulse is then passed through resistance 88 and diodes 90 and 92, to switch off the transitor 94, which is normally on, thereby operating relay 96 to open line 18. Thus the lamp 12 will be alternately switched off and on at the rate of pulsation of the timer 86, for example every 25 seconds.

The resistance 100 of the second battery voltage sensing and indicating means is set to detect a lower voltage than the variable resistance 80. The transitor 102 is normally on but when the voltage reaches this second lower predetermined level, transistor 102 will switch off and the thyristor 104 will be switched on via resistance 106 and diodes 108 and 110. The capacitor 112 can then charge and with the thyristor 104 on, the voltage between diodes 114 and 116 is reduced, reducing the voltage to transitor 94 disabling the relay 96 and opening line 18, thereby switching the lamp 12 off. It will be appreciated that with thyristor 104 activated the lamp 12 will remain permanently off.

At the same time the voltage to the base of transitor 36 is reduced, deactivating the relays 38 and 40, causing the batteries to revert to a series connection and will prevent the batteries from being switched to a parallel connection irrespective of the position of the switch 22.

The batteries comprising the power source are preferably of the nickel-cadmium type which can be rechargeable by a charger integrated within the torch or provided separately. The batteries can be charged by using either 110 volt/220 volt/240 mains AC charger or a 12 volt or 24 volt DC vehicle charger. The batteries can be trickle charged or fast charged as required. The bulb 12 can also be of the enclosed halogen type having its own integral reflector.

Figure 3:
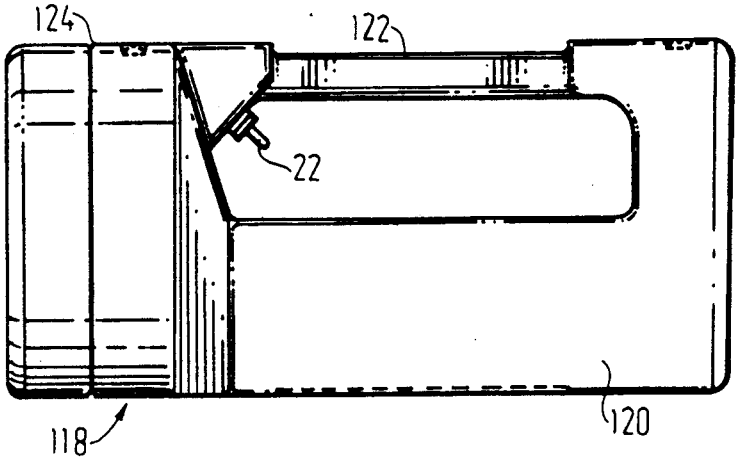
FIGS. 3, 4, and 5 show respectively, side and end elevations, and a plan view of a torch according to the present invention.
Figure 5:
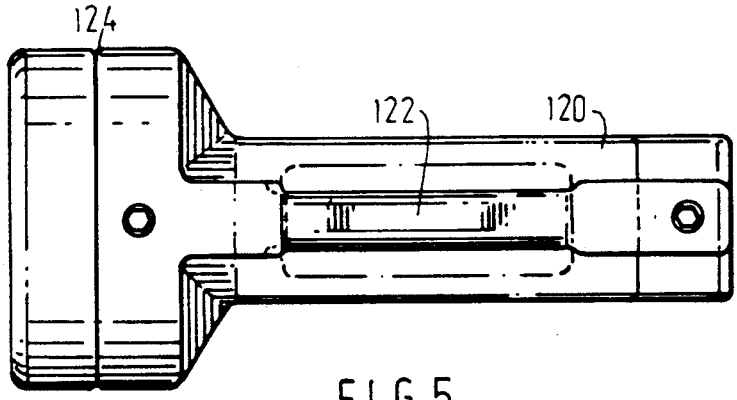
Figure 4:
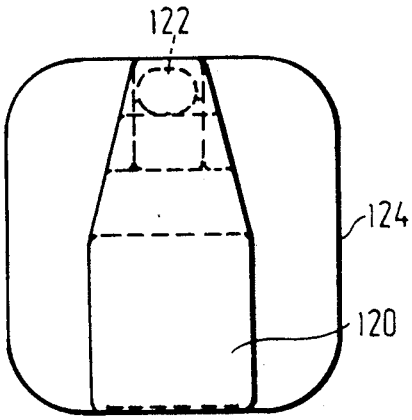

Referring to FIGS. 3, 4 and 5 there are shown external views of a torch 118 comprising an integrally moulded body including a battery housing 120 and lamp housing 124.

It will be seen that the battery housing 120 is rectangular in form as is also the lamp housing 124, though having radiused corners. The base of the battery housing 120 is continuous with the base of the lamp housing 124 and since both the battery housing 120 and lamp housing 124 are rectangular in section there is no tendency for the torch to roll.

Also the lamp can be stood upright on both ends without tipping, and also on the handle 122 without tipping.

Figure 6:
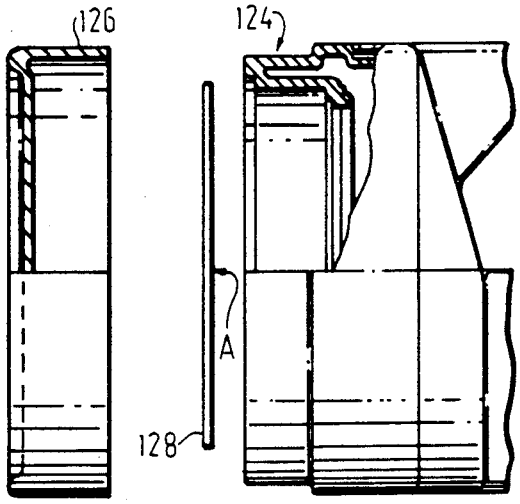
FIGS. 6 and 7 show part-sectional side and end elevations of the torch shown in FIGS. 3, 4, and 5 to a larger scale.
Figure 7:
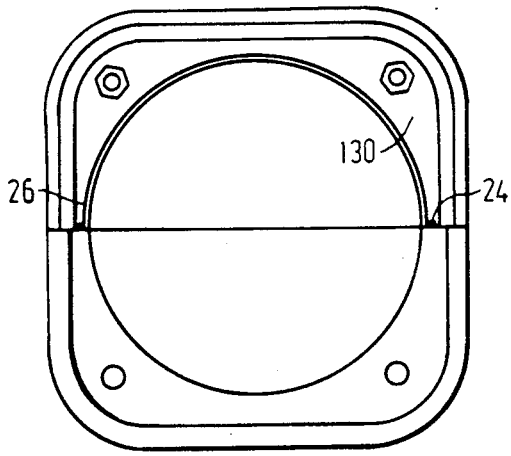
Figure 8:
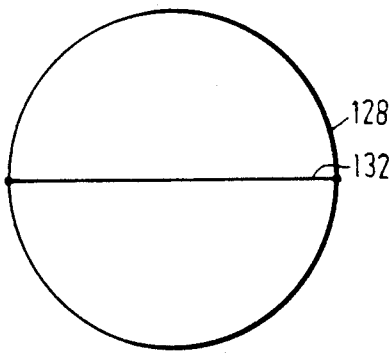
FIG. 8 shows a view on arrow A in FIG. 6.

Referring to FIGS. 6, 7, and 8 in which FIGS. 6 and 7 are half sections of part of the lamp housing 124, it will be the seen that the lamp housing 124 includes a cover 126 together with a circular translucent protective closure 128 which locates in a recess 130 in the lamp housing 124. The contacts 24, 26 (FIGS. 1 and 2) are located in the recess 130 as shown in FIG 7.

Referring to FIG. 8, a frangible conductive element 132 is shown and is arranged so that its ends contact the terminals 24 and 26.

We claim:

1. A torch having a direct current power supply, comprising:

at least one light source connected to the power supply by conductive elements, part of at least one said element comprising a length of frangible conductive material attached to a removable and breakable part of the torch; and a power supply control circuit having a manually operated switch, the switch having at least two positions allowing the power source to be connected or disconnected to the light source, the frangible conductive material being located in the conductive path to the manual switch.

2. A torch as claimed in claim 1, comprising a housing having an opening arranged to receive at the least one light source, the opening being closable by a translucent closure member, the frangible conductive material being attached to the translucent closure member and the ends of the frangible conductive material being arranged to contact terminals on said one of the conductive elements.

3. A torch as claimed in claim 1 in which the power supply control circuit includes switching means, enabling two or more batteries comprising the power source to be switched into a parallel array, or a series array.

4. A torch as claimed in claim 1 having a battery voltage sensing and indicating means to indicate at least one state of the power source voltage.

5. A torch as claimed in claim 4 in which the battery voltage sensing and indicating means, indicates a first state of the power source voltage by means of a flashing light and indicates a second state of the power source voltage by switching off the power supply to the light source.

6. A torch as claimed in claim 4 in which the battery voltage sensing and indicating means includes a first battery voltage sensing means comprising a first potential divider, a first integrated circuit having an output to switch on a transitor, having an output to a timer, the timer having an output to alternately switch off and on the power supply to the light source.

7. A torch as claimed in claim 6 in which the battery voltage sensing and indicating means includes a second battery voltage sensing and indicating means, comprising a second potential divider and integrated circuit having an input from the potential divider and an output to a transistor arranged to switch on a thyristor, the thyristor being arranged to permanently disconnect the power supply to the light source until manually re-set.

8. A torch as claimed in claim 4 in which the battery voltage sensing and indicating means includes first and second potential dividers each of which include a variable resistance.

9. A torch as claimed in claim 6 in which the battery voltage sensing and indicating means includes a relay operated switch to disconnect the power supply to the light source.

10. A torch as claimed in claim 1, comprising a body having a battery housing, a lamp housing and handle , the body including at least one portion having a flat bottom.

11. A torch as claimed in claim 10 in which the lamp housing is rectangular in cross-section.

12. A torch as claimed in claim 10 in which the battery housing is rectangular in cross-section.

13. A torch having a direct current power supply, comprising:

at least one light source connected to the power supply by conductive elements, part of at least one said element comprising a length of frangible conductive material attached to a removable and breakable part of the torch, said frangible conductive material being provided in the positive conductive element to the light source from the power supply.

* * * * *